US011872440B1

(12) United States Patent
Paliwoda

(10) Patent No.: US 11,872,440 B1
(45) Date of Patent: Jan. 16, 2024

(54) SUPPLEMENTAL MULTI-PURPOSE EXERCISE STRAP

(71) Applicant: Michael Paliwoda, Parma Heights, OH (US)

(72) Inventor: Michael Paliwoda, Parma Heights, OH (US)

( * ) Notice: Subject to any disclaimer, the term of this patent is extended or adjusted under 35 U.S.C. 154(b) by 21 days.

(21) Appl. No.: 17/659,678

(22) Filed: Apr. 19, 2022

(51) Int. Cl.
*A63B 21/00* (2006.01)

(52) U.S. Cl.
CPC ..... *A63B 21/4043* (2015.10); *A63B 21/4035* (2015.10); *A63B 21/4001* (2015.10); *A63B 2225/09* (2013.01)

(58) Field of Classification Search
CPC ..... A63B 21/4001; A63B 21/4035; A63B 21/4043; A63B 2225/09
See application file for complete search history.

(56) References Cited

U.S. PATENT DOCUMENTS 5,209,712 A * 5/1993 Ferri ..... A61H 1/02 482/131
7,044,896 B2 * 5/2006 Hetrick ..... A63B 21/0023 482/141
8,043,197 B2 * 10/2011 Hetrick ..... A63B 21/4043 482/904
8,083,653 B2 * 12/2011 Hetrick ..... A63B 21/1663 482/904
8,197,392 B2 6/2012 Silverman et al.
8,944,976 B2 * 2/2015 Crowell ..... A63B 21/00043 482/121
10,245,460 B2 * 4/2019 Hetrick ..... A63B 21/4035
10,857,413 B2 * 12/2020 Hetrick ..... A63B 21/4035
11,311,763 B2 * 4/2022 Yeates ..... A63B 21/018
11,400,334 B2 * 8/2022 Hetrick ..... A63B 21/151
2010/0113235 A1 * 5/2010 Calvagne ..... A63B 7/02 482/143
2013/0157821 A1 * 6/2013 Crowell ..... A63B 21/4034 482/129
2014/0274569 A1 * 9/2014 Lewen ..... A63B 21/0421 482/121
2018/0140886 A1 * 5/2018 Hetrick ..... A63B 21/068
2019/0091507 A1 * 3/2019 Hetrick ..... A63B 21/4043
2021/0052933 A1 * 2/2021 Hetrick ..... A63B 21/4043
2021/0353991 A1 * 11/2021 Yeates ..... A63B 21/00043
2022/0362616 A1 * 11/2022 Hetrick ..... A63B 21/1663

OTHER PUBLICATIONS

Multi-Loop Stretching Strap (www.prosourcefit.com).
Spud Inc Looper Strap (www.roguefitness.com).
Adjustable Pulley Loop (www.spud-inc-straps.com).
Nade Strap (www.spud-inc-straps.com).

* cited by examiner

*Primary Examiner* — Joshua Lee
(74) *Attorney, Agent, or Firm* — Kramer Law Clinic

(57) ABSTRACT

A supplemental multi-purpose exercise strap for customizing an exercise machine to accomplish a variety of exercises. The strap includes a center attachment member and a plurality of loop members. A first set of loop members is attached to the front of the strap and extend from the center of the strap towards the first end of the strap, while a second set of loop members is attached to the front of the strap and extend from the center of the strap towards the second end of the strap. The loop members are configured to accept a variety of exercise accessories and machines, which allows the strap to assist a user in accomplishing a wide variety of exercises.

5 Claims, 7 Drawing Sheets

SUPPLEMENTAL MULTI-PURPOSE EXERCISE STRAP

TECHNICAL FIELD

The invention generally relates to supplemental exercise equipment, particularly multi-purpose exercise straps with a plurality of loops for use with variety of machines and exercises.

BACKGROUND OF THE INVENTION

The cable operated exercise machines are one of the most popular pieces of gym equipment—they offer users a variety of exercises to choose from and fit in a small space with limited equipment set-up time. Even though cable operated exercise machines are very popular, they have numerous limitations, such as poor leverage due to lack of body stability and a limitation to the number of exercises that are compatible with the machine.

Attempts have been made to make exercise machines more compatible with different exercises and accessories. U.S. Pat. No. 8,197,392 to Silverman, et. al. describes a strap with a plurality of loops. To the loops exercise accessories can be attached. However, this device is only compatible with vertical mounts and cannot hold weights to increase the resistance for a user.

Additionally, products like the "Spud Inc Loop Strap" are sold to allow for chains and other weights to be incorporated into squat, bench, or overhead press machines. However, these straps are only designed to hold weights, not other accessories. This, again, limits a user in the types of exercises they can do.

As such, there is a need for a multi-purpose exercise strap that can maximize the full potential of exercise machines by allowing for increased customization and versatility. Specifically, there is a need for straps that increase body support and leverage, as well as an ability for straps to combine exercise machines with versatile accessories. Consequently, any simple exercise machine will be able to offer the same capabilities as a commercial gym filled with dozens of different machines.

SUMMARY OF THE INVENTION

It is therefore an object of the present invention to provide for a supplemental multi-purpose exercise strap that can increase body support and leverage to allow for training with increased weight and reduce the risk of injury.

It is a further object of the present invention to provide for a supplemental multi-purpose exercise strap which achieves the above object and which also allows for an exercise machine to be combined with small, mobile, and versatile accessories, which allows a user to accomplish a variety of exercises.

The invention achieves the above objects, and other objects and advantages which will become apparent from the description which follows, by providing an exercise device including a strap having a front face, a back face, a first end, and a distal second end. Located in the center of the strap is an attachment member. Along the strap is a first set of loop members defining a first set of first ends attached to the front face of the strap and a first set of distal free ends, wherein the first set of loop members begin at the center of the strap and are oriented with the first set of free ends towards the first end of the strap. Additionally, the strap has a second set of loop members defining a second set of first ends attached to the front face of the strap and a second set of distal free ends, wherein the second set of loop members begin at the attachment member and are oriented with the second set of free ends towards the second end of the strap. With the above-described exercise device, a user can attach the attachment member to an exercise machine and can attach accessories to the loop members along different points of the strap to accommodate various exercises.

In the preferred embodiments of the invention, the device is provided with a third set of loop members attached to the back of the strap. Additionally, the third set of loop members and the attachment member include O-rings, which allows for more versatility in attaching to accessories and exercise machines.

The invention also achieves the above objects by providing a method for using an exercising device strap. The method begins with the step of providing a strap having a front, a back, a first end, and a second end, and a center attachment member located at the top of the strap. Attached to the front of the strap is a first set of loop members oriented towards the first end of the strap. Also attached to the front of the strap is a second set of loop members oriented towards the second end of the strap. A third set of loop members are attached to the back of the strap and are oriented towards the center attachment member. The next step is anchoring the strap by way of the center attachment member to an exercise machine. Then, attaching the first, second, and third set of loop members to an exercise accessory. The next step is positioning a user's body in such a way that the exercise machine and the exercise accessory are engaged. The final step is moving the user's body as to create a resistance between the user and the exercise machine.

DETAILED DESCRIPTION OF THE PREFERRED EMBODIMENTS

Figure 1:
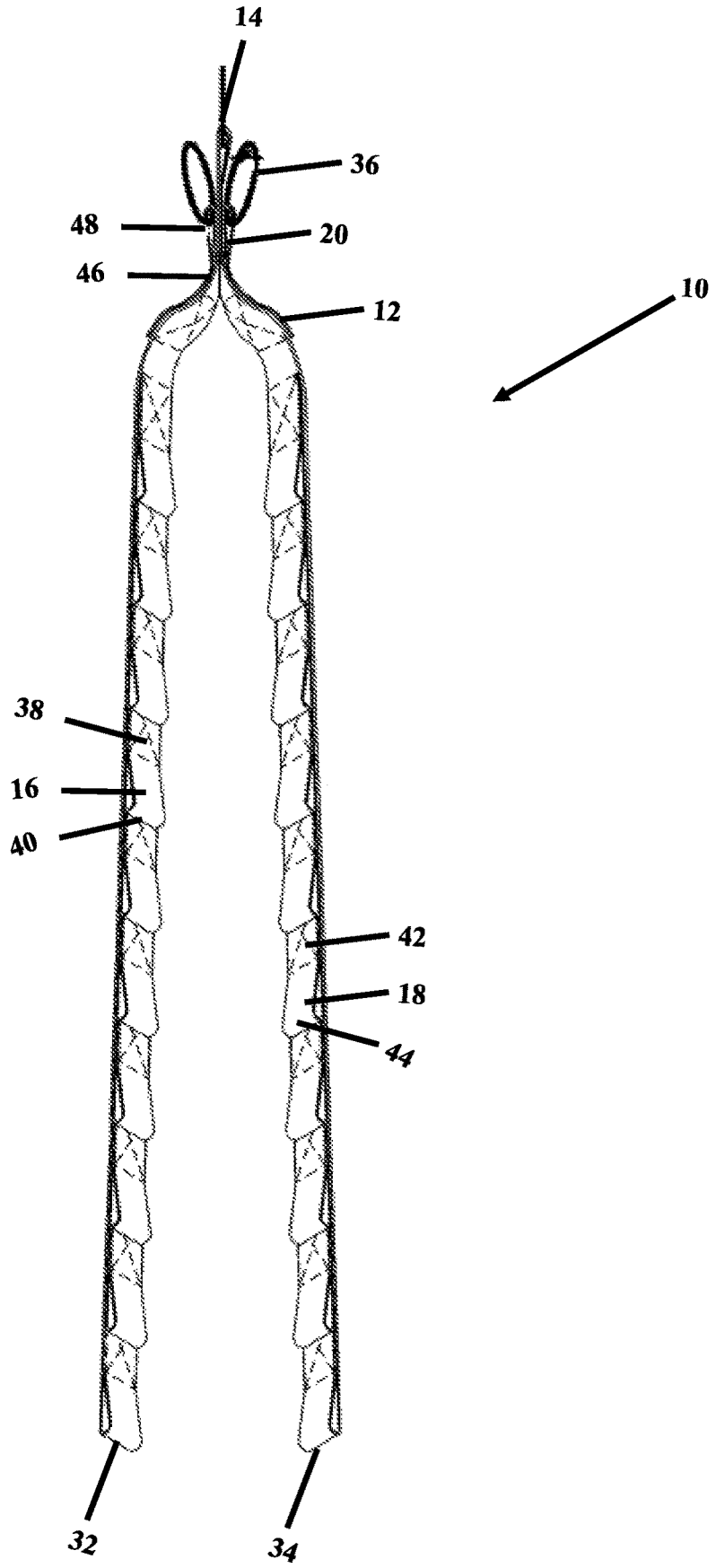
FIG. 1 is an isometric perspective view of an exemplary supplemental multi-purpose exercise strap.

A supplemental multi-purpose exercise strap in accordance with the principles of the invention is generally indicated at bracketed reference numeral 10 in the various figures of the attached drawings wherein numbered elements in the figures correspond to like numbered elements herein.

Figure 2:
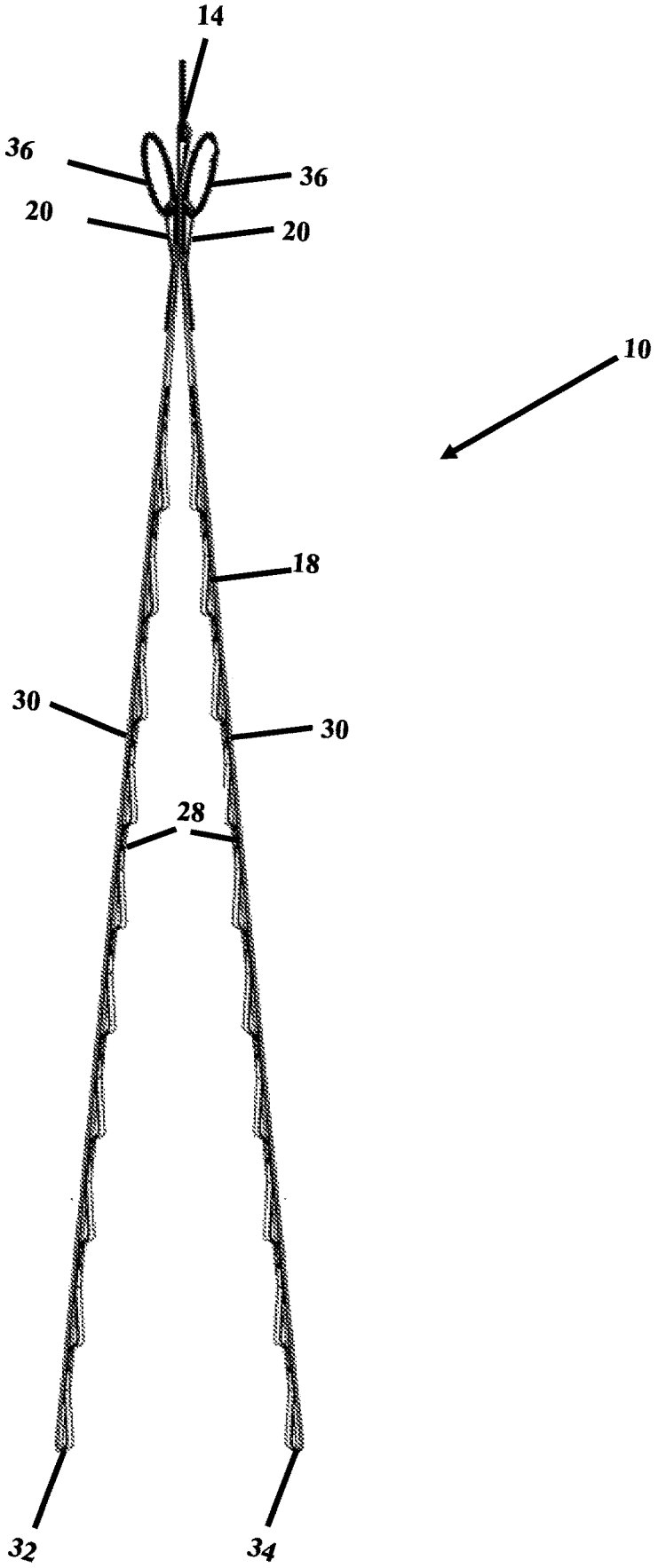
FIG. 2 is a side elevated view of a supplemental multi-purpose exercise strap.
Figure 3:
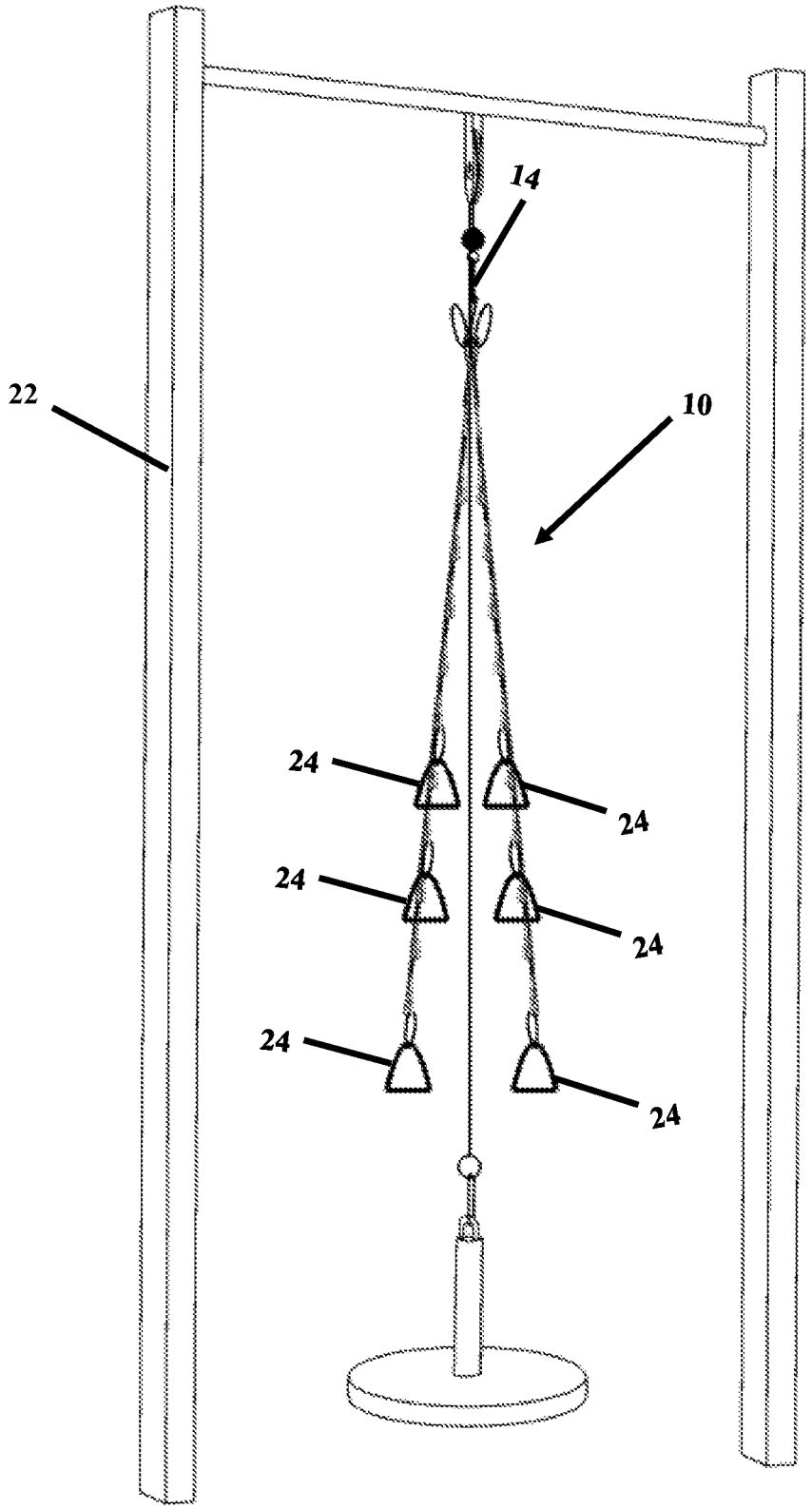
FIG. 3 is a perspective view of the supplemental multi-purpose exercise strap attached to an exercise machine and with handle attachments attached to the strap.

Referring now to the drawing and initially to FIGS. 1 and 2, there is shown an exercise device 10, including a strap 12, an attachment member 14 a first set of loop members 16, a second set of loop members 18, and a third set of loop members 20. When the attachment member 14 is attached to an exercise machine 22 and the loop members 16, 18, 20 are attached to an exercise accessory 24, a user 26 may accomplish a variety of exercises, as shown in FIGS. 3-7.

The strap 12 includes a front face 28, a back face 30, a first end 32, and a distal second end 34. Located equidistant between the first end 32, and second end 34 is a center of the strap 12. The attachment member 14 is located at the center of the strap 12. The attachment member 14 is configured to be received by an exercise machine 22. The attachment member 14 may include a round ring, D-ring, carabiner, or other anchor. In the preferred embodiment, as shown in FIGS. 1 and 2 the attachment member 14 is a loop member with an O-ring attached to the loop member.

Along the strap 12 is a first set of loop members 16. The first set of loop members 16 has a first set of first ends 38 and a first set of distal free ends 40. The first ends 38 are attached to the front face 28 of the strap 12. The free ends 40 are oriented towards the first end 32 of the strap 12. Preferably, the first set of loop members 16 begin at the attachment member 14 and terminate at the first end 32. Additionally, the strap 12 has a second set of loop members 18. The second set of loop members 18 has a second set of first ends 42 attached to the front face 28 and a second set of distal free ends 44. The second set of loop members 18 are oriented with the second set of free ends 44 towards the second end 34 of the strap 12. Preferably, the second set of loop members 18 begin at the attachment member 14 and terminate at the second end 34.

In some embodiments, the strap 12 has a third set of loop members 20. The third set of loop members 20 has a third set of first ends 46 and a third set of distal free ends 48. The third set of loop members 20 are attached to the back face 30 of the strap 12 through the first ends 46 and the third set of loop members 20 are oriented with the third set of free ends 48 extending towards the attachment member 14.

In the preferred embodiment of the exercise device 10, there are two loop members in the third set of loop members 20 and each loop member includes an O-ring 26. Additionally, there are ten loop members in the first set of loop members 16 and ten loop members in the second set of loop members 18.

The exercise device 10 may be made from polyester, polypropylene, nylon, cotton, leather, or any other suitable type of material. Preferably, the device 10 has a width between 1 and 4 inches. The loop members 16, 18, 20 may include one or more attachment elements, such as an adhesive or polyester threading, which allow for the loop members 16, 18, 20 to be attached to the strap 12. The loop members 16, 18, 20 can also be made from folding the strap 12 into the preferred orientation and stitching the loops in place. Preferably, the loop members 16, 18, 20 are attached along the strap 20 through box-X stitching. In the preferred embodiment, the loop members 16, 18, 20 have a 2 inch diameter opening and are attached to the strap 12 with a 3 inch stitching pattern length and 2 inch stitching pattern width. The distance between the stitching pattern and each loop member is 1 inch.

Referring now to FIGS. 3-7, there is shown an exercise device 10 being used by a user 26. The method of using the exercise device begins with providing a strap 12 having a front 28, a back 30, a first end 32, and a second end 34, and a center attachment member 14 located at a center of the strap 12. Attached to the front 28 of the strap 12 is a first set of loop members 16 oriented towards the first end of the strap 32. Also attached to the front 28 of the strap 12 is a second set of loop members 18 oriented towards the second end 34 of the strap 12. A third set of loop members 20 are attached to the back 30 of the strap 12 and are oriented towards the center attachment member 14. The next step is anchoring the exercise device 10 by way of the center attachment member 14 to an exercise machine 22. This is accomplished by attaching a separate carabineer or other suitable attachment device to the attachment member 14. In addition, the user 26 may secure the center attachment member 14 to an adjustable length anchor strap which is set at a position that prevents the user 26 from exceeding a normal range of motion to protect against injury.

Then, the next step is the user 26 attached the first, second, or third set of loop members 16, 18, 20 to an exercise accessory 24, such as a resistance band, harness, weights, chains, handles, or other small, mobile, and versatile accessories 24. The next step is positioning a user's body 26 in such a way that the exercise machine 22 and the exercise accessory 24 are engaged. The final step is moving the user's body 26 as to create a resistance between the user 26 and the exercise machine 22. The exercise machine 22 may be a cable pulley machine, an adjustable weight bench, a free weight machine, a horizontal mount, a vertical mount, and a squatting-platform system.

Figure 4:
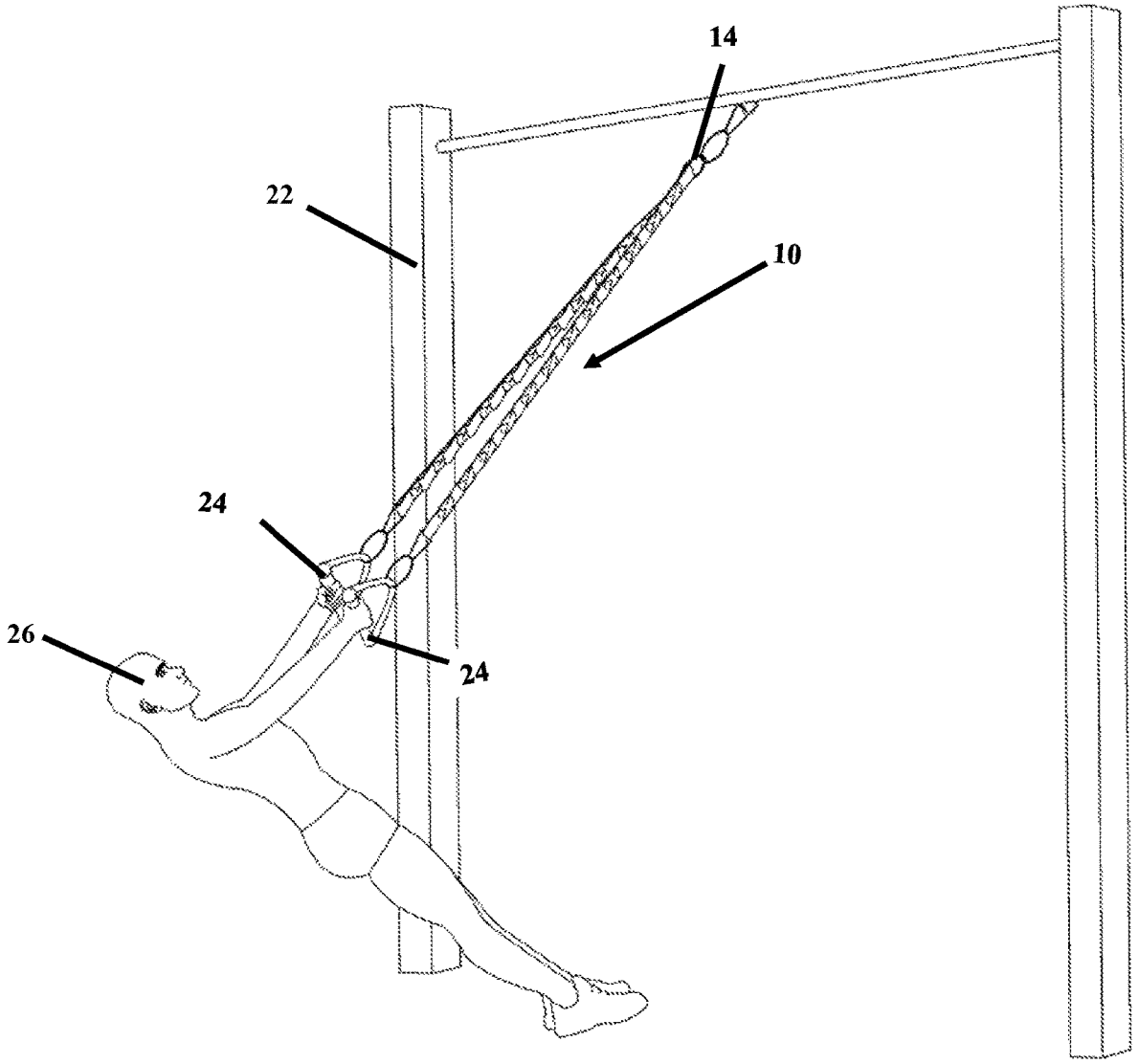
FIG. 4 is a perspective view of a user performing a suspended body weight row exercise with the supplemental multi-purpose exercise strap.

FIG. 4 shows the user 26 performing a suspended bodyweight row. The advantage of using the supplemental multipurpose exercise strap 10 in this and other suspended bodyweight exercises is that the user can select from a wide variety of grips, handles, and straps to attach and detach from the supplemental multi-purpose exercise strap 10 to perform a wide variety of exercises. The option to attach and detach grips, handles, resistance bands, and straps is an improvement on a standard suspension trainer which has the handles built into the strap.

Figure 5:
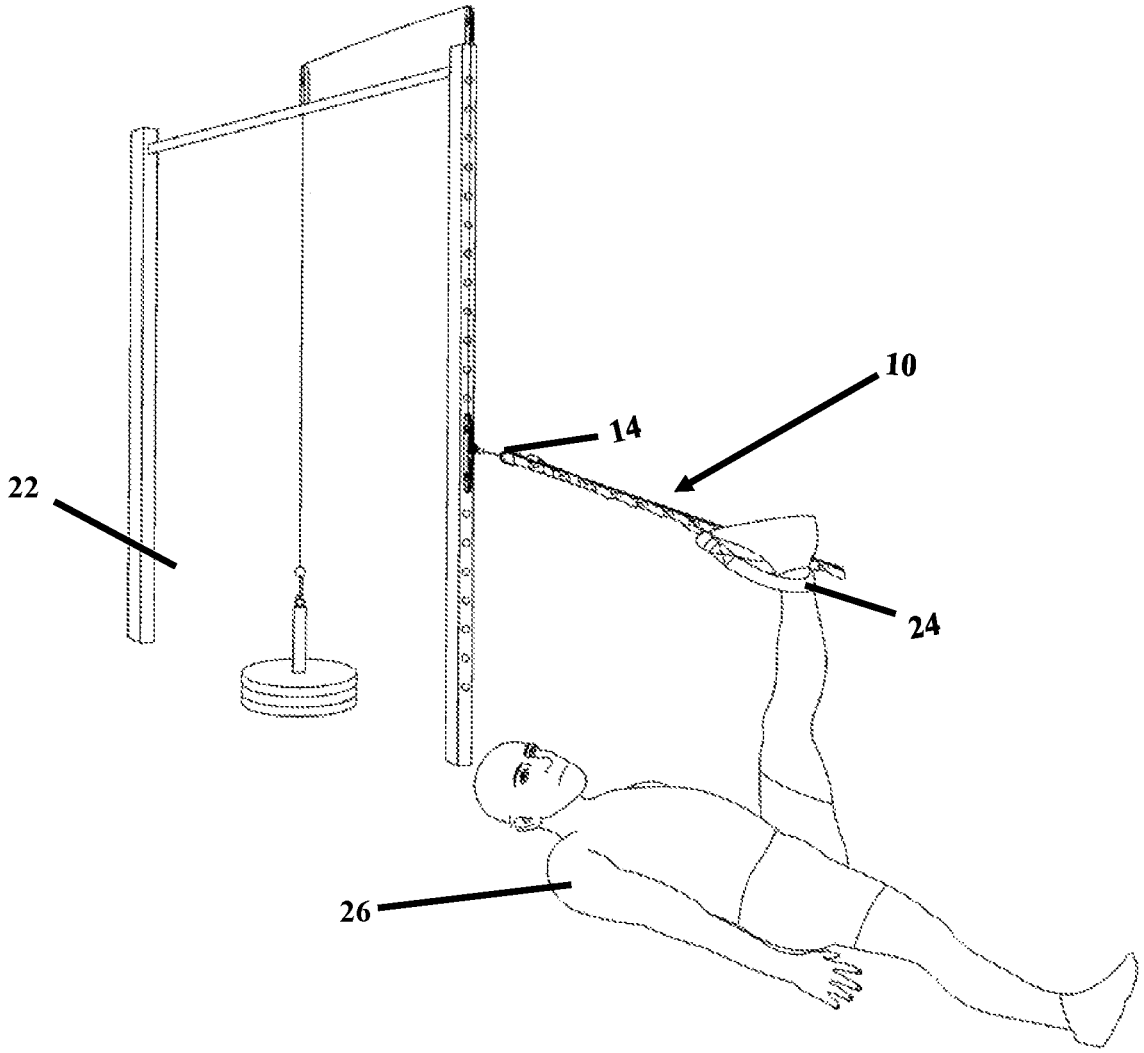
FIG. 5 is a perspective view of a user performing a lying hamstring stretch with the supplemental multi-purpose exercise strap.

FIG. 5 shows the user 26 performing an exercise with the supplemental multi-purpose exercise strap 10 being used as a stretching device. This is accomplished by attaching the attachment member 14 to a cable machine pulley 22. The user 26 then selects from a choice of strap attachments to connect to the appropriate loop members 16, 18, 20. The user must place enough weight on the cable machine to securely hold the arm or leg that is being stretched in place. FIG. 5 specifically shows the user 26 performing a lying hamstring stretch. The advantage of using the supplemental multi-purpose exercise strap 10 in this exercise and other exercises is that the exercise machine, horizontal, or vertical support 22 provides the leverage assistance, whereby the user 26 does not have to provide the assistance by pulling on the strap, thus eliminating fatigue in the arms and shoulders and allowing for a greater stretch due to the increased leverage.

Figure 6:
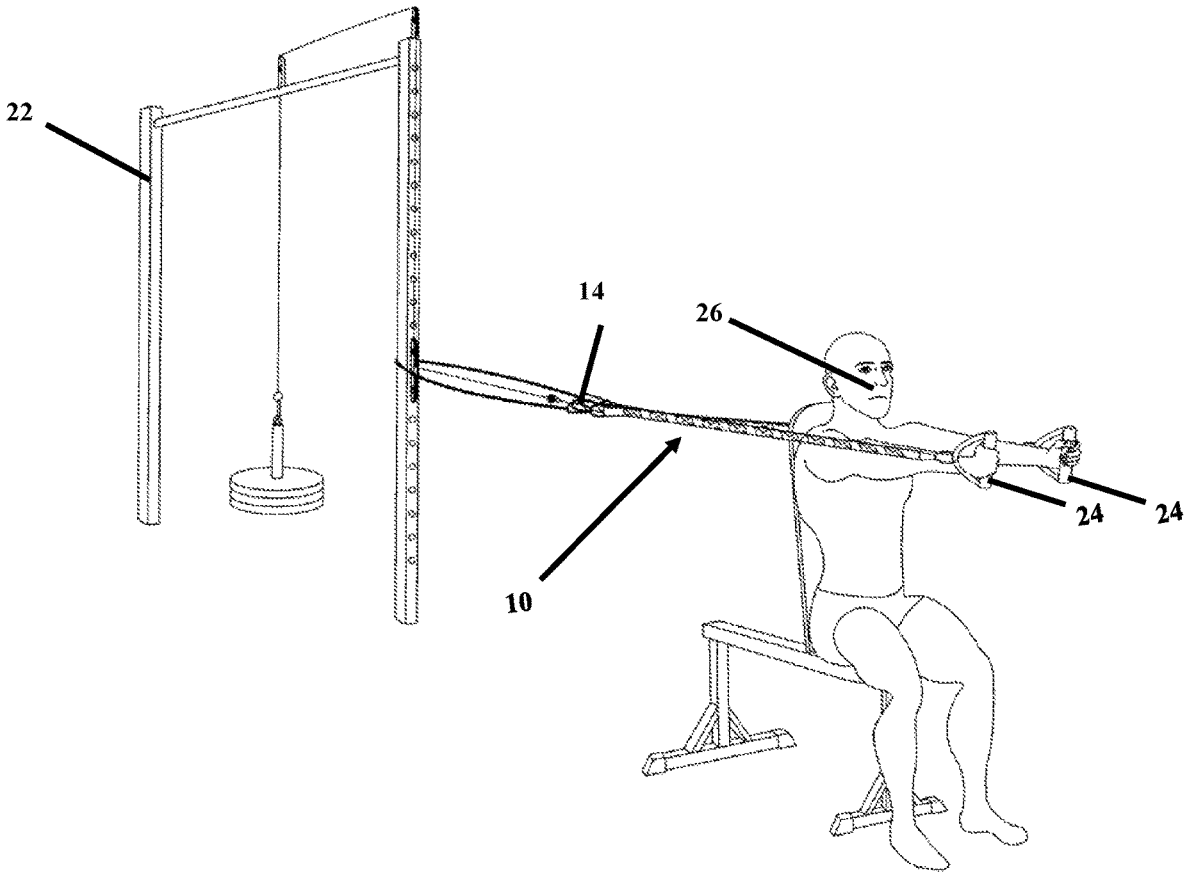
FIG. 6 is a perspective view of a user performing a seated horizontal press exercise with the supplemental multi-purpose exercise strap.

FIG. 6 shows a user 26 doing a seated horizontal press. The advantage of using supplemental multi-purpose exercise strap 10 in this exercise and other cable machine exercises is that it allows for the inclusion of body stabilizing equipment, such as, but not limited to, an adjustable bench. The user 26 also has the benefit of selecting from a wide variety of grips, handles, resistance bands, and straps to connect to the supplemental multi-purpose exercise strap and selecting from a wide variety of exercises to perform. The ability to combine a cable machine 22 with body stabilization equipment makes supplemental multi-purpose exercise strap unique.

Figure 7:
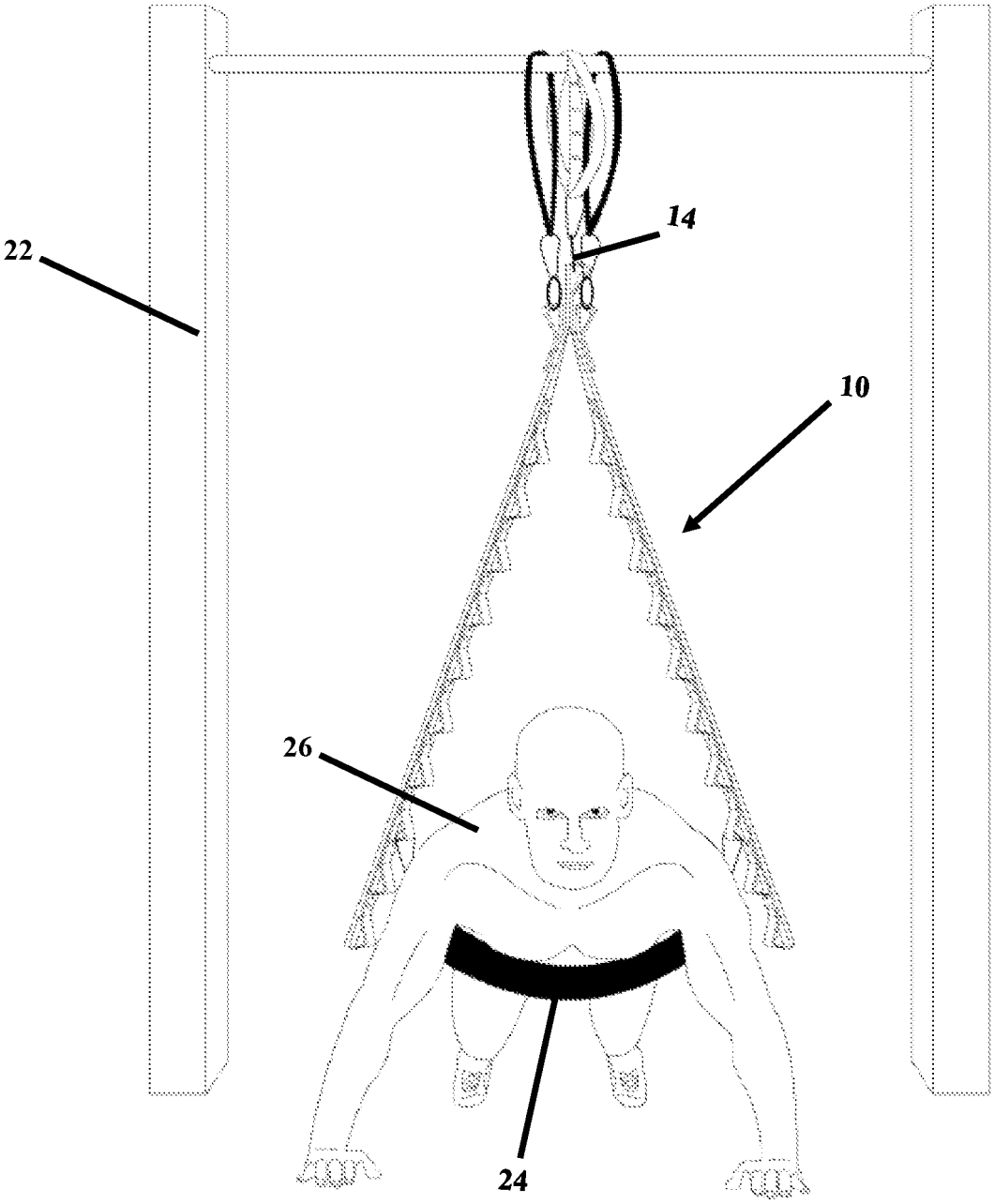
FIG. 7 is a front perspective view of a user performing an assisted push up exercise with the supplemental multi-purpose exercise strap.

FIG. 7 shows the user 26 performing an assisted push up exercise. The advantage of using the supplemental multipurpose exercise strap 10 in this and other suspended bodyweight assisted exercises is that the user 26 can perform a wide variety of exercises that otherwise may not be possible without band assistance acting as a counterweight. Some users 26 need assistance to achieve a full range of motion for exercises, which the supplemental multi-purpose exercise strap 10 provides. In addition, some users 26 who are strong enough to perform a given exercise may want to continue performing the exercise after muscular exhaustion has been reached. At this point, the user is not able to continue performing the exercise at full bodyweight, and the reliance on the counterweight bands becomes essential. The supplemental multi-purpose exercise strap 10 provides the most assistance at the point where the user is the weakest to assist in injury prevention. The benefits as shown in FIGS. 3-7, and described above, apply to all exercises performed while using the supplemental multi-purpose exercise strap 10.

Those of ordinary skill in the art will conceive of other alternate embodiments of the invention upon reviewing this disclosure. Thus, the invention is not to be limited to the above description but is to be determined in scope by the claims which follow.

What is claimed is:

1. An exercise device, comprising:

a strap having a front face, a back face, a first end, and a distal second end;

an attachment member located at a center of the strap, equidistant from the first end and the second end;

a first set of loop members defining a first set of first ends attached to the front face of the strap and a first set of distal free ends, wherein a loop member of the first set of loop members begins at the center of the strap and the remaining loop members in the first set of loop members are each positioned progressively further away from the center of the strap, wherein the first set of loop members are oriented with the first set of distal free ends towards the first end of the strap;

a second set of loop members defining a second set of first ends attached to the front face of the strap and a second set of distal free ends, wherein a loop member of the second set of loop members begin at the attachment member and the remaining loop members in the second set of loop members are each positioned progressively further away from the attachment member, wherein the second set of loop members are oriented with the second set of free ends towards the second end of the strap, whereby a user can attach the attachment member to an exercise machine and can attach accessories to the loop members along different points of the strap to accommodate various exercises; and a third set of loop members defining a third set of first ends attached to the back face of the strap and a third set of distal free ends, wherein the third set of loop members are oriented with the third set of free ends towards the attachment member.

2. The exercise device of claim 1, wherein the third set of loop members include O-rings attached to the third set of distal free ends.

3. The exercise device of claim 1, wherein the first set of loop members includes ten loop members, and the second set of loop members includes ten loop members.

4. A method for using an exercising strap device, comprising the following steps:

providing a strap having a front, a back, a first end, and a second end, a center attachment member located at a center of the strap, a first set of loop members attached to the front of the strap, wherein the first set of loop members are oriented towards the first end of the strap, a second set of loop members attached to the front of the strap, wherein the second set of loop members are oriented towards the second end of the strap, and a third set of loop members attached to the back of the strap, wherein the third set of loop members are oriented towards the center attachment member;

anchoring the strap by way of the center attachment member to an exercise machine;

attaching at least one of the first, second, and third set of loop members to an exercise accessory;

positioning a user's body in such a way that the exercise machine and the exercise accessory are engaged; and moving the user's body as to create a resistance between the user and the exercise device.

5. The method of claim 4, wherein the exercise machine is selected from the group consisting of: a cable pulley machine, an adjustable weight bench, a free weight machine, a horizontal mount, a vertical mount, and a squatting-platform system.

* * * * *